US005286397A

United States Patent [19]

Schmid et al.

[11] Patent Number: 5,286,397

[45] Date of Patent: Feb. 15, 1994

[54] BASE OIL FOR THE LUBRICANT INDUSTRY

[75] Inventors: Karl Schmid, Mettmann; Frank Bongardt, Duesseldorf; Reinhold Wuest, Kaarst, all of Fed. Rep. of Germany

[73] Assignee: Henkel Kommanditgesellschaft auf Aktien, Dusseldorf, Fed. Rep. of Germany

[21] Appl. No.: 836,333

[22] PCT Filed: Aug. 23, 1990

[86] PCT No.: PCT/EP90/01404

§ 371 Date: Mar. 2, 1992

§ 102(e) Date: Mar. 2, 1992

[87] PCT Pub. No.: WO91/03531

PCT Pub. Date: Mar. 21, 1991

[30] Foreign Application Priority Data

Sep. 1, 1989 [DE] Fed. Rep. of Germany ..... 3929069

[51] Int. Cl.[5] ..... C10M 129/68

[52] U.S. Cl. ..... 252/56 S; 524/314; 252/56 R

[58] Field of Search ..... 252/56 S, 56 R; 524/314

[56] References Cited

U.S. PATENT DOCUMENTS

| | | | |
|---|---|---|---|
| 4,425,458 | 1/1984 | Lindner et al. | 524/314 |
| 4,731,190 | 3/1988 | O'Lenick, Jr. et al. | 252/56 S |
| 4,830,769 | 5/1989 | O'Lenick, Jr. et al. | 252/56 S |

*Primary Examiner*—Jacqueline V. Howard
*Attorney, Agent, or Firm*—Ernest G. Szoke; Wayne C. Jaeschke; Real J. Grandmaison

[57] ABSTRACT

A low-viscosity lubricant composition stable to high and low temperatures containing an ester oil which is the esterfication product of an aliphatic dicarboxylic acid having 8 or 9 carbon atoms and a branched Guerbet alcohol having from 12 to 20 carbon atoms.

14 Claims, No Drawings

BASE OIL FOR THE LUBRICANT INDUSTRY

FIELD OF THE INVENTION

This invention relates to a low-viscosity ester oil resistant to high and low temperatures based on an aliphatic dicarboxylic acid and a correspondingly selected Guerbet alcohol.

DISCUSSION OF RELATED ART

The history of ester oils goes back more than 50 years during which increasingly more efficient ester oils have been developed due to the particular requirements of the lubricant industry. The first generation of synthetic aircraft turbine oils based on diesters of adipic, azelaic and sebacic acid with aliphatic alcohols played an important role, particularly in civil and military aviation (see M. Wildersohn, Tribologie und Schmierungstechnik, Vol. 32, pages 70 to 75, 1985 and Ullmann, Vol. 20, pages 457 to 671, 1984).

By comparison with the less expensive, but ecologically hazardous mineral oils, ester oils are distinguished by better viscosity/temperature behavior, by a distinctly better load bearing capacity at high temperatures coupled with lower volatility and, in particular, by distinctly lower pour points.

Nevertheless, there is still considerable interest in new synthetic ester oils of which the use in vehicle oils and industrial lubricants is particularly in demand precisely when the load bearing limit of hitherto known ester oils and mineral oils is exceeded.

DESCRIPTION OF THE INVENTION

Other than in the operating examples, or where otherwise indicated, all numbers expressing quantities of ingredients or reaction conditions used herein are to be understood as modified in all instances by the term "about".

Accordingly, the problem addressed by the present invention was to provide new synthetic diesters of dibasic carboxylic acids with monohydric alcohols which would be distinguished from known ester oils by improved temperature/viscosity behavior, as expressed by a higher viscosity index, and by improved low temperature properties, a lower evaporation loss and a higher flash point.

The technical solution to the problem addressed by the present invention is based on the choice of a certain alcohol component and couples this choice of the hydroxyl group component with the choice of a certain dicarboxylic acid on the acid side for the production of a new ester oil having surprising properties.

Now, the present invention relates to low-viscosity lubricant compositions stable to high and low temperatures based on ester oils prepared by the known esterification of a dicarboxylic acid with a fatty alcohol, characterized in that the ester oils contain the esterification product of aliphatic dicarboxylic acids containing 8 and/or 9 carbon atoms and branched Guerbet alcohols or Guerbet alcohol mixtures containing at least 12 to 20 carbon atoms.

Numerous examples of ester oils made up of aliphatic dicarboxylic acid components are already known from the prior art, so that the choice of suberic acid and/or azelaic acid, preferably azelaic acid, in accordance with the invention may be basically regarded as known.

However, it is the choice of the alcohol component derived from a Guerbet alcohol or a mixture of Guerbet alcohols containing at least 12 to 20 carbon atoms which is the core of the teaching according to the invention, as shown in the following. The trivial name of Guerbet alcohol is used for 2-alkyl-substituted 1-alkanols of which the industrial synthesis is described in detail, for example, in H. Machemer, Angewandte Chemie, Vol. 64, pages 21314 220 (1952) and in G. Dieckelmann and H. J. Heinz in "The Basics of Industrial Oleochemistry", pages 145–146 (1988).

In one preferred embodiment of the present invention, the Guerbet alcohol component of the ester oils is derived at least partly from 2-hexyl decanol, 2-hexyl dodecanol, 2-octyl decanol and/or 2-octyl dodecanol, the use of 2-hexyl decanol being particularly preferred.

The actual esterification reaction is carried out in known manner by reaction of 1 mol dicarboxylic acid with at least 2 mol Guerbet alcohol in the presence of an esterification catalyst, the water formed during the reaction being removed by distillation.

Ester oils preferred in accordance with the invention have a kinematic viscosity (according to DIN 51 562) at 40° C. of approximately 7 to 50 $mm^2/s$ and preferably in the range from about 15 to 40 $mm^2/s$. These low viscosity values are to some extent surprising in view of the relatively high molecular weight because comparable polyol esters of lower molecular weight, such as for example trimethylol propane esterified with adipic acid, give ester oils of considerably higher viscosity.

With a viscosity index (according to DIN ISO 2909) of at least about 150 and preferably of at least about 160, the ester oils according to the invention show excellent viscosity/temperature behavior which is also reflected in the pour points of about −40° to −65° C. and preferably below −55° C., as determined in accordance with DIN ISO 3016.

In the context of the invention, it is not only low-temperature behavior, but also high-temperature behavior which plays an important role. By virtue of their flash points of at least 250° to about 300° C. and preferably above 270° C., as determined in accordance with DIN ISO 2592, the new ester oils according to the invention are particularly suitable for applications involving exposure to heat. In this context, the evaporation losses of 0% by weight at 200° C., approximately 1% by weight at 250° C. and approximately 5 to 10% by weight at 300° C., as determined by thermogravimetric analysis at a heating rate of 1° C./minute, are also of importance.

By virtue of their favorable tribological properties, the dicarboxylic acid ester oils according to the invention are particularly suitable as lubricant compositions in industrial transmission oils, hydraulic fluids and/or cooling lubricants in the processing of metals, plastics and textiles and as lubricating additives in any of the fields mentioned. To improve the lubricating character, additives, such as oxidation and corrosion inhibitors, dispersants, high-pressure additives, foam inhibitors, metal deactivators, may be used in the usual effective quantities.

EXAMPLES

General Procedure for the Preparation of the Dicarboxylic Acid Esters

The corresponding dicarboxylic acid and the selected Guerbet alcohol (in a slight excess) were esterified for 6 to 8 hours at around 160° to 240° C. in the presence of 0.1% by weight tin(II) oxalate, the water formed during the reaction being removed by distillation. Towards the end of the reaction, esterification was continued under reduced pressure at the same temperature. After cooling to 90° C., approximately 0.5 to 1% bleaching earth was added for wet bleaching and the reaction product was filtered off after cooling.

Further particulars of product properties A-F (kinematic viscosity, viscosity index, cloud point, pour point and flash point) of the dicarboxylic acid esters can be found in Table 1. To allow a comparison to be made with lubricants known from the prior art, Table 2 shows the same product properties A-F for comparable lubricants.

TABLE 1

| Compound | A | B | C | D | E | F |
|---|---|---|---|---|---|---|
| Bis-(2-hexyldecyl)-azelate | 33 | 6.6 | 160 | −39 | −64 | 278 |
| Bis-(2-hexyldodecyl)-azelate/ bis-(2-octyldecyl)-azelate (1:1 mixture) | 39 | 7.5 | 164 | −36 | −57 | 278 |
| Bis(2-octyldecyl)-azelate | 42 | 8.2 | 170 | −36 | −43 | 276 |

Legend
A Kinematic viscosity at 40° C. according to DIN 51562 (in $mm^2/s$)
B Kinematic viscosity at 100°C. according to DIN 51562 (in $mm^2/s$)
C Viscosity index according to DIN ISO 2909 (in VI)
D Cloud point according to DIN ISO 3015 (in °C.)
E Pour point according to DIN ISO 3016 (in °C.)
F Flash point according to DIN ISO 2592 (in °C.)

TABLE 2

| Comparison compounds | A | B | C | D | E | F |
|---|---|---|---|---|---|---|
| Bis-(2-octyldodecl)-sebacate | 42.1 | 8.7 | 195 | −5 | −5 | 270 |
| Bis-(2-ethylhexyl)-sebacate | 11.6 | 3.4 | 185 | −35 | −70 | 200 |
| Bis-(2-isotridecyl)-adipate | 27 | 5.2 | 136 | −20 | −50 | 230 |
| Bis-(2-isodecyl)-adipate | 14 | 3.6 | 140 | −30 | −60 | 230 |
| Poly-α-olefin | 30.5 | 5.5 | 132 | — | −54 | 232 |
| Mineral oil (paraffinic) | 38.5 | 5.5 | 68 | — | −15 | 205 |
| Mineral oil (naphthenic) | 46 | 5.4 | 14 | — | −39 | 190 |

Legend
A Kinematic viscosity at 40° C. according to DIN 51562 (in $mm^2/s$)
B Kinematic viscosity at 100°C. according to DIN 51562 (in $mm^2/s$)
C Viscosity index according to DIN ISO 2909 (in VI)
D Cloud point according to DIN ISO 3015 (in °C.)
E Pour point according to DIN ISO 3016 (in °C.)
F Flash point according to DIN ISO 2592 (in °C.)

The ester oils according to the invention described in Table 1 surprisingly have much higher flash points than the viscosity-conforming comparison compounds, particularly the mineral oils, for excellent low-temperature properties. Even comparable ester oils having the same or higher molecular weights based on aliphatic dicarboxylic acids, such as adipic or a sebacic acid, do not remotely approach the low-temperature properties of the ester oils according to the invention.

We claim:

1. A low-viscosity lubricant composition stable to high and low temperature comprising as the main component an ester oil which is the esterfication product of an aliphatic dicarboxylic acid containing 8 or 9 carbon atoms and a branched Guerbet alcohol containing from 12 to 20 carbon atoms, said ester oil having a kinematic viscosity at about 40° C. as determined per DIN 51,562 of from about 7 to about 50 $mm^2/s$, and the balance, at least one lubricant additive to 100% by weight of said lubricant composition.

2. A lubricant composition as in claim 1 wherein said aliphatic dicarboxylic acid is selected from the group consisting of suberic acid and azelaic acid.

3. A lubricant composition as in claim 1 wherein said Guerbet alcohol is selected from the group consisting of 2-hexyl decanol, 2-hexyl dodecanol, 2-octyl decanol, and 2-octyl dodecanol.

4. A lubricant composition as in claim 1 wherein said ester oil has a viscosity index as determined per DIN ISO 2909 of at least about 150.

5. A lubricant composition as in claim 1 wherein said ester oil has a pour point as determined per DIN ISO 3016 of from about −40° C. to about −65° C.

6. A lubricant composition as in claim 1 wherein said ester oil has a flash point as determined per DIN ISO 2592 of from about 250° C. to about 300° C.

7. A lubricant composition as in claim 1 wherein said ester oil has been prepared by esterifying about 1 mol of said dicarboxylic acid with at least about 2 mol of said Guerbet alcohol in the presence of an esterfication catalyst, and the water formed during the reaction being removed by distillation.

8. The process of lubricating a surface, comprising contacting said surface with an ester oil which is the esterification product of an aliphatic dicarboxylic acid containing 8 or 9 carbon atoms and a branched Guerbet alcohol containing from 12 to 20 carbon atoms.

9. The process as in claim 8 wherein said aliphatic dicarboxylic acid is selected from the group consisting of suberic acid and azelaic acid.

10. The process as in claim 8 wherein said Guerbet alcohol is selected from the group consisting of 2-hexyl decanol, 2-hexyl dodecanol, 2-octyl decanol, and 2-octyl dodecanol.

11. The process as in claim 8 wherein said ester oil has a kinematic viscosity at about 40° C. as determined per DIN 51,562 of from about 7 to about 50 $mm^2/s$, and a viscosity index as determined per DIN ISO 2909 of at least about 150.

12. The process as in claim 8 wherein said ester oil has a pour point as determined per DIN ISO 3016 of from about −40° C. to about −65° C.

13. The process as in claim 8 wherein said ester oil has a flash point as determined per DIN ISO 2592 of from about 250° C. to about 300° C.

14. The process as in claim 8 wherein said ester oil has been prepared by esterifying about 1 mol of said dicarboxylic acid with at least about 2 mol of said Guerbet alcohol in the presence of an esterfication catalyst, and the water formed during the reaction being removed by distillation.

* * * * *